US005265541A

United States Patent [19]

Gordon

[11] Patent Number: 5,265,541

[45] Date of Patent: Nov. 30, 1993

[54] BED SUPPORTED DESK APPARATUS

[76] Inventor: Chester D. Gordon, 19023 Galway Ave., Carson, Calif. 90746

[21] Appl. No.: 856,389

[22] Filed: Mar. 23, 1992

[51] Int. Cl.[5] ..... A47B 3/00

[52] U.S. Cl. ..... 108/34

[58] Field of Search ..... 108/34, 35, 36, 25, 108/14; 312/226, 233, 244, 313, 319.2, 351.9, 902

[56] References Cited

U.S. PATENT DOCUMENTS

| | | | |
|---|---|---|---|
| 49,821 | 9/1865 | Ziegler | 108/25 |
| 1,573,691 | 2/1926 | Eichberg | 108/129 |
| 2,248,871 | 7/1941 | Howe | 108/25 |
| 2,272,819 | 2/1942 | Poetsch et al. | 312/313 |
| 2,285,576 | 6/1942 | Fox | 188/25 |
| 2,293,496 | 8/1942 | Egger | 108/25 |
| 3,080,835 | 3/1963 | Gugliclmi | 108/129 |
| 4,483,427 | 11/1984 | Gerch | 190/11 |
| 5,115,893 | 5/1992 | Terkildsen | 190/11 |

*Primary Examiner*—Peter R. Brown
*Assistant Examiner*—Janet M. Long
*Attorney, Agent, or Firm*—Hugh E. Smith

[57] ABSTRACT

An apparatus in association with a bed organizer that includes foldable leg tubes telescopingly receiving extensions therewithin for mounting upon a top surface of an associated bed permitting an individual to project that individual's legs between the leg tubes and below an associated desk housing that in turn includes a lid mounted to the housing for storage of components therewithin, as well as lid plate hingedly mounted to the lid to include extension legs received within a groove within a top surface of the desk lid. A support shelf is reciprocatably mounted within the support housing, with the leg tubes pivotally mounted to a folded position in contiguous communication with the support housing for ease of storage thereof.

4 Claims, 5 Drawing Sheets

BED SUPPORTED DESK APPARATUS

BACKGROUND OF THE INVENTION

1. Field of the Invention

The field of invention relates to bed and apparatus therefore, and more particularly pertains to a new and improved bed supported desk apparatus wherein the same is arranged for providing a desk structure in association with a bed organizer.

2. Description of the Prior Art

Bed related apparatus of various types is utilized throughout the prior art for ease and comfort of individuals. Many individuals are required to spend extended periods of time within a bed and accordingly organizations to enhance ease and comfort are required. Further, the instant invention attempts to overcome deficiencies of the prior art by providing a multi-purpose desk structure in association with a bed for ease by use of individuals within the bed organization.

Prior art desk structure of various types as exemplified in U.S. Pat. No. 4,795,210 to Milat wherein a portable table is arranged for use in self-propelled vehicles for mounting relative to a vehicular seat.

U.S. Pat. No. 4,715,293 to Cobbs sets forth a body supported writing desk.

U.S. Pat. No. 4,765,583 to Tenner sets forth an example of a lap supported desk.

As such, it may be appreciated that there continues to be a need for a new and improved bed supported desk apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of bed apparatus now present in the prior art, the present invention provides a bed supported desk apparatus wherein the same is arranged for mounting to a top surface of a desk in an adjustable relationship thereto. As such, the general purpose of the present invention, which will be described subsequently in greater detail, is to provide a new and improved bed supported desk apparatus which has all the advantages of the prior art bed apparatus and none of the disadvantages.

To attain this, the present invention provides an apparatus in association with a bed organization that includes foldable leg tubes telescopingly receiving extensions therewithin for mounting upon a top surface of an associated bed permitting an individual to project that individual's legs between the leg tubes and below an associated desk housing that in turn includes a lid mounted to the housing for storage of components therewithin, as well as lid plate hingedly mounted to the lid to include extension legs received within a groove within a top surface of the desk lid. A support shelf is reciprocatably mounted within the support housing, with the leg tubes pivotally mounted to a folded position in contiguous communication with the support housing for ease of storage thereof.

My invention resides riot in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bed supported desk apparatus which has all the advantages of the prior art bed apparatus and none of the disadvantages.

It is another object of the present invention to provide a new and improved bed supported desk apparatus which may be easily and efficiently manufactured and marketed.

It is a further object of the present invention to provide a new and improved bed supported desk apparatus which is of a durable and reliable construction.

An even further object of the present invention is to provide a new and improved bed supported desk apparatus which is susceptible of a low cost of manufacture with regard to both materials and labor, and which accordingly is then susceptible of low prices of sale to the consuming public, thereby making such bed support desk apparatus economically available to the buying public.

Still yet another object of the present invention is to provide a new and improved bed supported desk apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
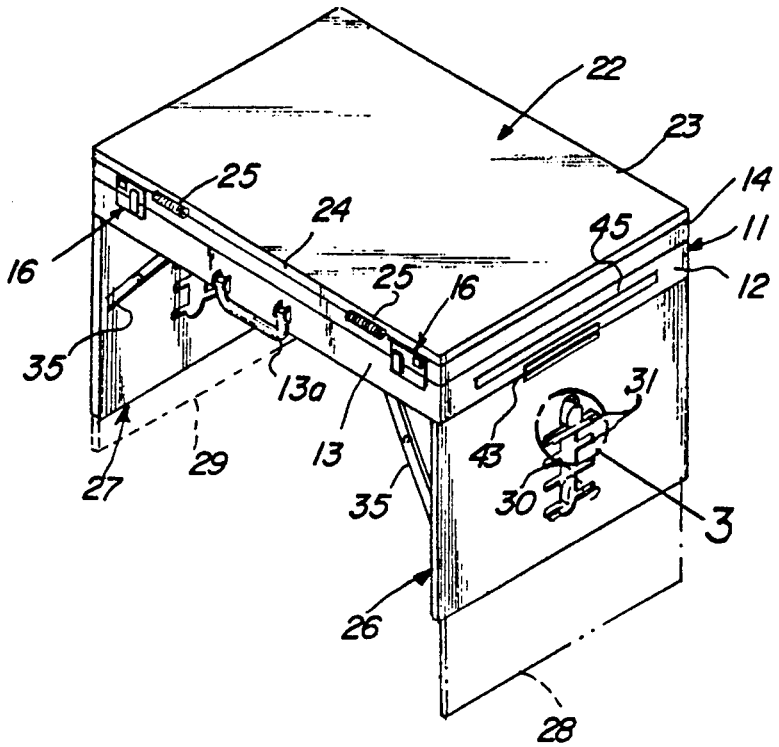
FIG. 1 is an isometric illustration of the instant invention.

With reference now to the drawings, and in particular to FIGS. 1 to 10 thereof, a new and improved bed supported desk apparatus embodying the principles and concepts of the present invention and generally designated by the reference numeral 10 will be described.

Figure 2:
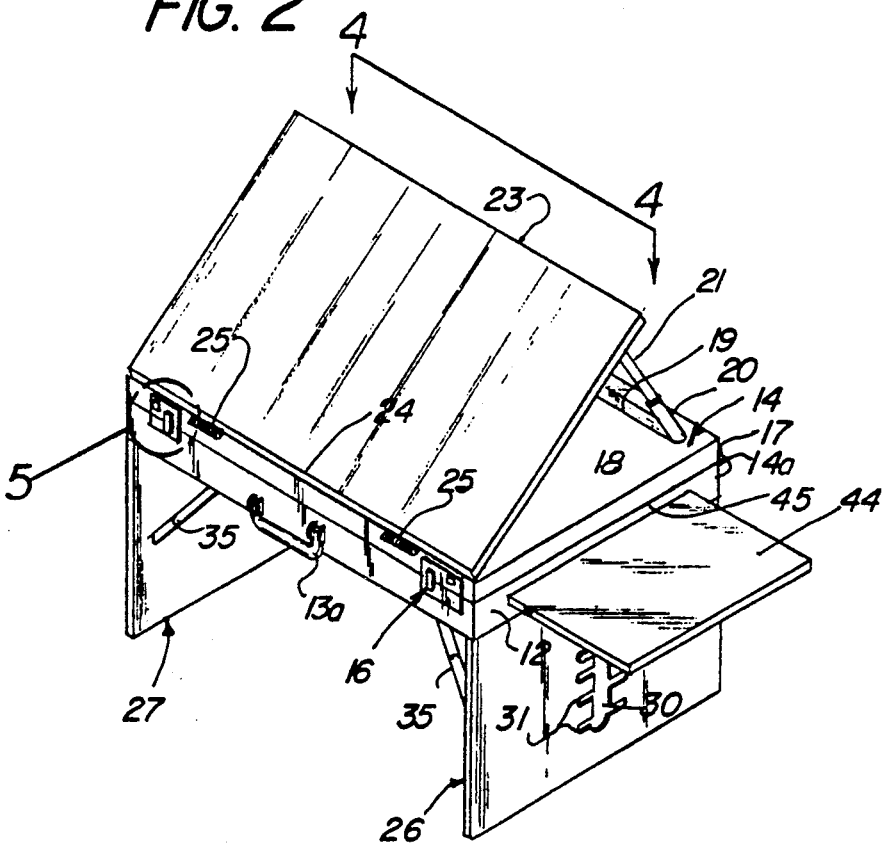
FIG. 2 is an isometric illustration of the instant invention illustrating the container lid support plate raised to an elevated orientation relative to the underlying container structure.
Figure 3:
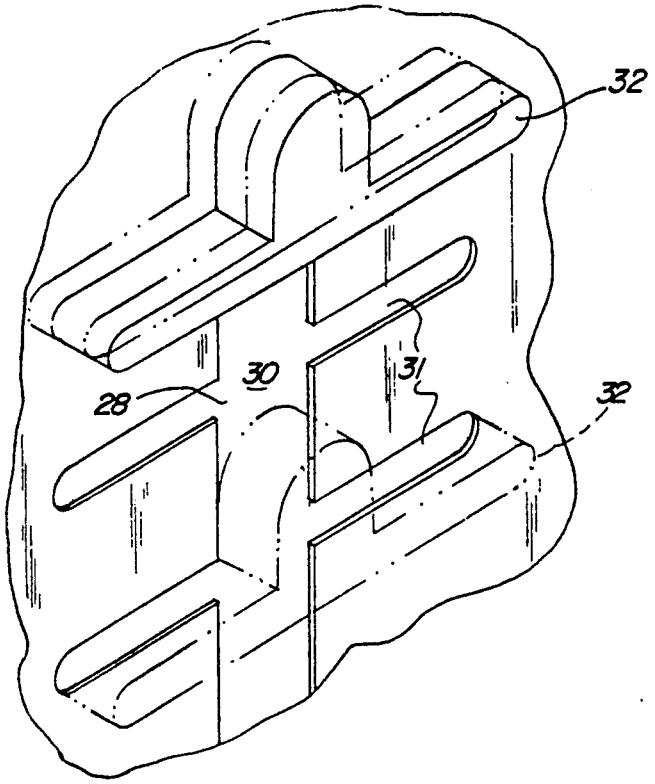
FIG. 3 is an enlarged isometric illustration of section 3 as set forth in FIG. 1.
Figure 4:
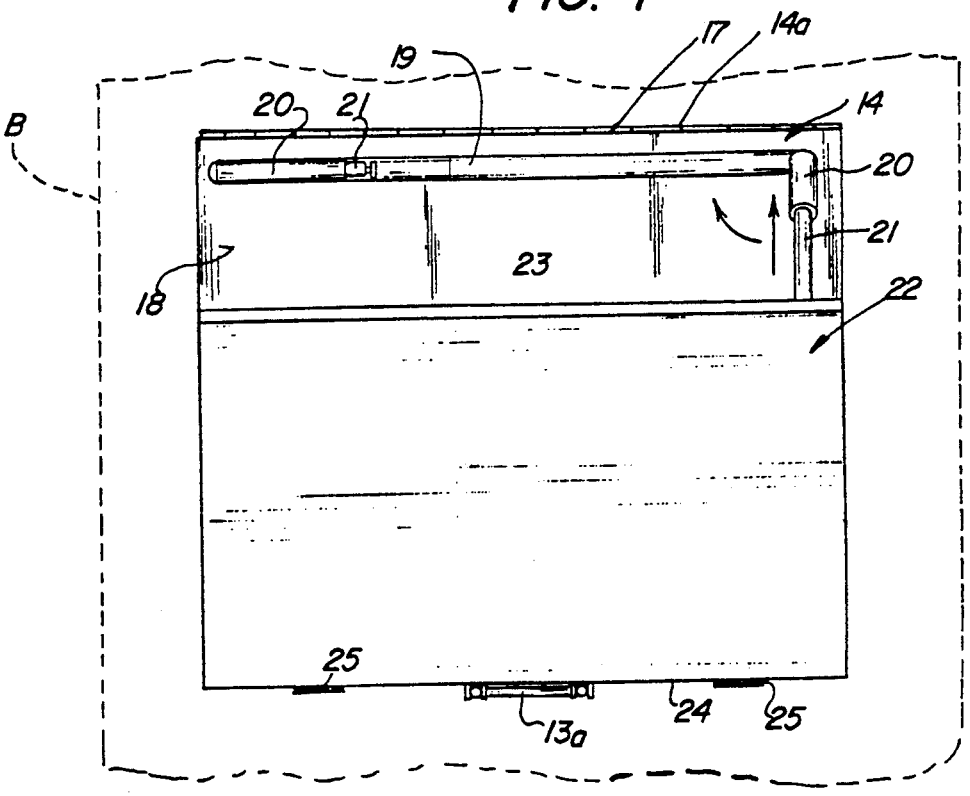
FIG. 4 is an orthographic view, taken along the lines 4—4 of FIG. 2 in the direction indicated by the arrows.
Figure 5:
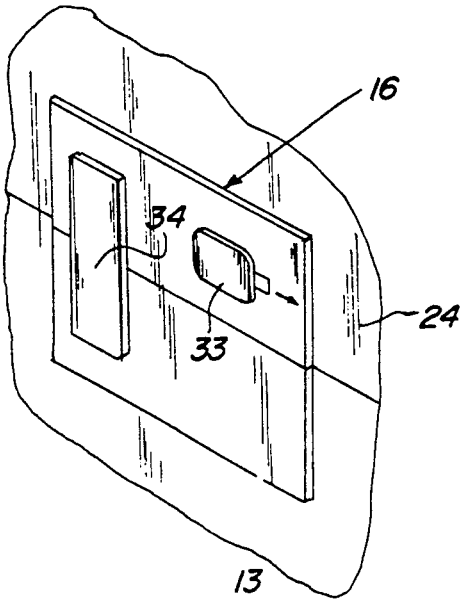
FIG. 5 is an enlarged isometric illustration of section 5 as set forth in FIG. 2.

More specifically, the bed supported desk apparatus 10 of the instant invention is arranged for positioning upon an associated bed structure "B" to a top surface thereof, such as illustrated in FIG. 4, to project upwardly therefrom permitting an individual to recline in bed having access to the organization. A support housing 11 includes housing side walls 12, housing front wall 13, and a housing rear wall 17. A housing lid 14 is hingedly mounted to the rear wall 17 by a housing lid hinge 14*a* defined as a first hinge. The housing lid 14 is selectively latched to the housing front wall 13 by at least one or a plurality of latches 16 of conventional construction to typically utilize a slide latch 33 individually or in combination with a rotary latch bar 34. The housing lid 14 includes a container lid support plate 22 (also referred to as container lid 22) hingedly mounted to the housing lid to a forward edge thereof adjacent the latches 16 utilizing a container lid support plate front edge 24 mounting a plurality of support plate hinges 25 hingedly mounting the container lid to the housing lid by the support plate hinges 25 defined as second hinges. The container lid 22 is of a configuration to contiguously and coextensively overlie the housing lid 14 in a lowered orientation and is pivotal relative to the housing lid to a raised orientation, such as illustrated in FIG. 2. The container lid rear edge 23 is arranged to receive an upper terminal end of a bottom leg tube extension 21 telescopingly received within the bottom leg tube 20. A plurality of such tubes are provided and mounted within an associated enclosed groove 19 oriented parallel relative to the rectilinear housing rear wall 17, wherein the leg tubes 20 and extensions 21 are raised from the groove where it is understood that the groove is of a predetermined depth substantially equal to the predetermined diameter of the bottom leg tube 20 to contain the bottom tube and the associated extension therewithin in the first position, as illustrated in FIG. 1, permitting the container lid to be oriented relative to the housing lid in the contiguous relationship as illustrated. A right and left parallelepiped leg tube 26 and 27 respectively is hingedly mounted adjacent each respective right and left side wall 12 about a leg tube hinge 43 defined as a fourth hinge, with each right and left leg tube including leg tube locking struts 35 to latch the leg tubes in an orthogonal relationship relative to a bottom surface of the support housing 11 to subsequently permit their interfolding relative to the bottom surface for ease of storage of the organization during periods of non-use. The right and left leg tubes 26 and 27 include respective right and left leg extension plates 28 and 29 that are telescopingly received relative to each leg tube, with each leg tube including a latch slot 30, with orthogonally intersecting and communicating arresting slots 31 that are orthogonally oriented relative to the latch slot, wherein a "T" shaped latch projection 32 is mounted to each extension plate (see FIG. 3 for example). The "T" shaped latch projection 32 is of a spring-biased construction projecting exteriorly of the latch slot 30 and the associated arresting slot, wherein the "T" shaped latch projection 32 is normally biased exteriorly, as illustrated in FIG. 3, and is depressed to permit the telescoping projection of a respective extension plate relative to the associated leg tube.

Figure 6:
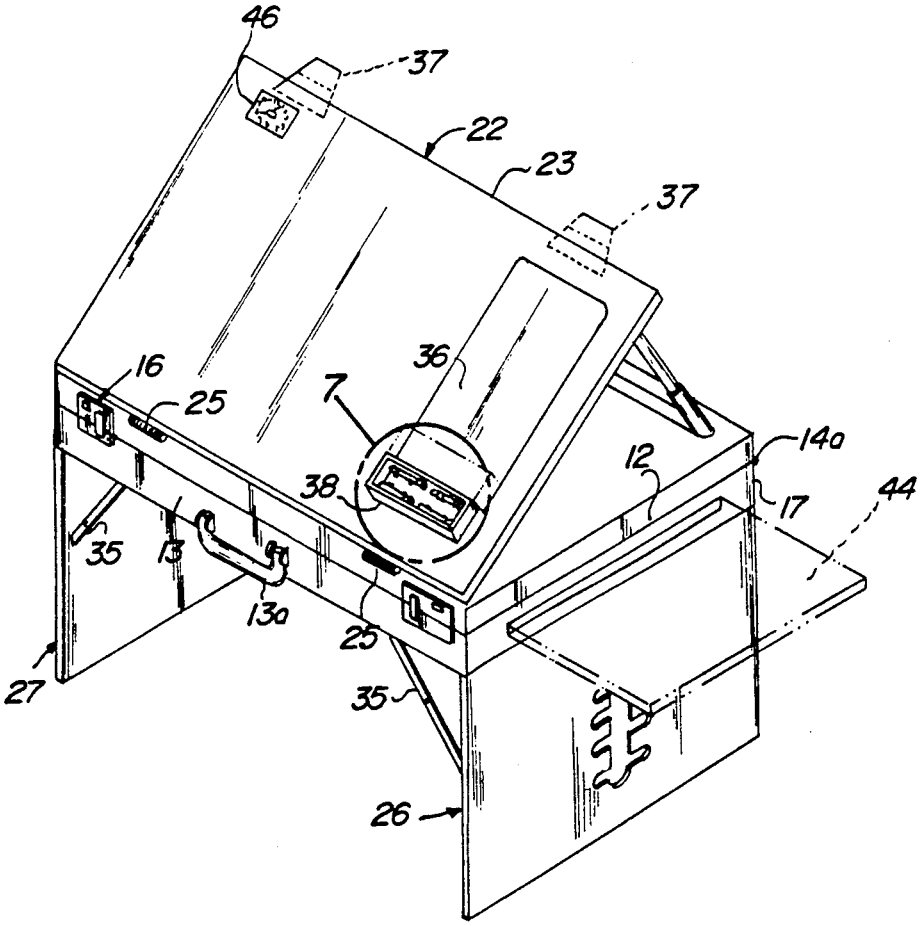
FIG. 6 is an isometric illustration of the desk utilizing a drafting plate insert mounted within the container lid support plate.
Figure 7:
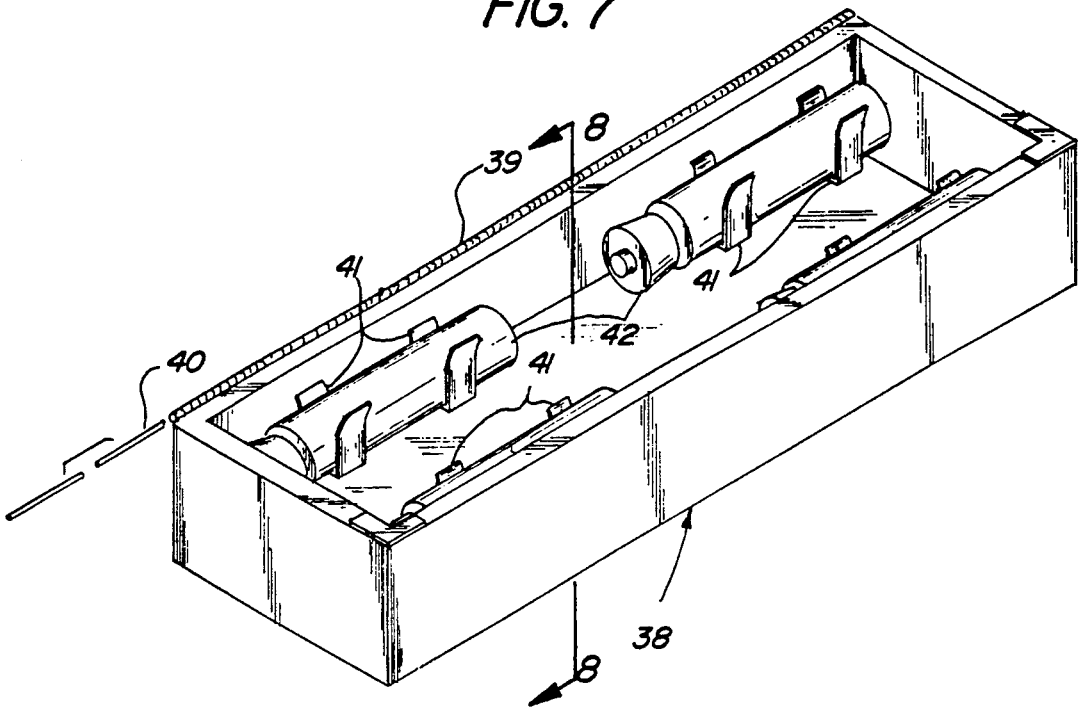
FIG. 7 is an enlarged isometric illustration of section 7 as set forth in FIG. 6.
Figure 8:
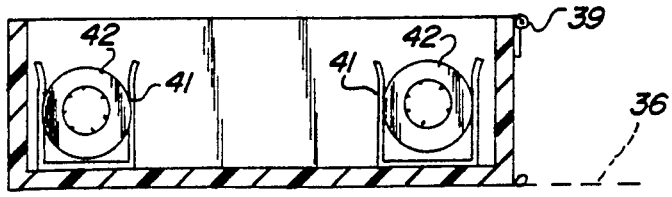
FIG. 8 is an orthographic view, taken along the lines 8—8 of FIG. 7 in the direction indicated by the arrows.

FIG. 6 illustrates the use of support clasp members 37 mounted to the container lid rear edge 23 for selective clamping of papers mounted thereon. A clock member 46 is recessed within a top surface of the container lid support plate 22, as well as a rigid "white" polymeric web insert 36 arranged in a coplanar relationship relative to the top surface of the support plate 22 for use in providing a reflective surface in drafting and the like, wherein accordingly, a writing instrument container 38 is provided and hingedly about an instrument container hinge defined as a third hinge 39 to hingedly mount the writing instrument container 38 to a lower edge of the web insert 36. The third hinge 39 includes a third hinge removable rod 40 providing for selective removal of the container 38 relative to the top surface of the support plate 22 for access to various writing instruments 42 contained within the instrument container 39. The writing instruments 42 are secured by plural pairs of "U" shaped spring jaws 41 mounted to a floor of the writing instrument container 38 for ease of access thereto.

Finally it should be noted that at least one slide plate 44 received within a slide plate socket 45 through at least one, if not both, housing side walls 12 is provided for extended table top space in use of the organization. It is understood that an identical slide plate 44 may be received within an associated socket 45 orthogonally relative to each side wall as required.

It should be noted that upon interfolding of the right and left leg tubes 26 and 27 to the bottom surface or bottom wall of the support housing 11 and upon projection of the associated slide plates 44 within the support housing 11, as well as the contiguous mounting in a first position of the support plate 23 onto the housing lid top wall, the handle 13*a* mounted medially of the housing front wall permits ease of transport of the organization.

Figure 9:
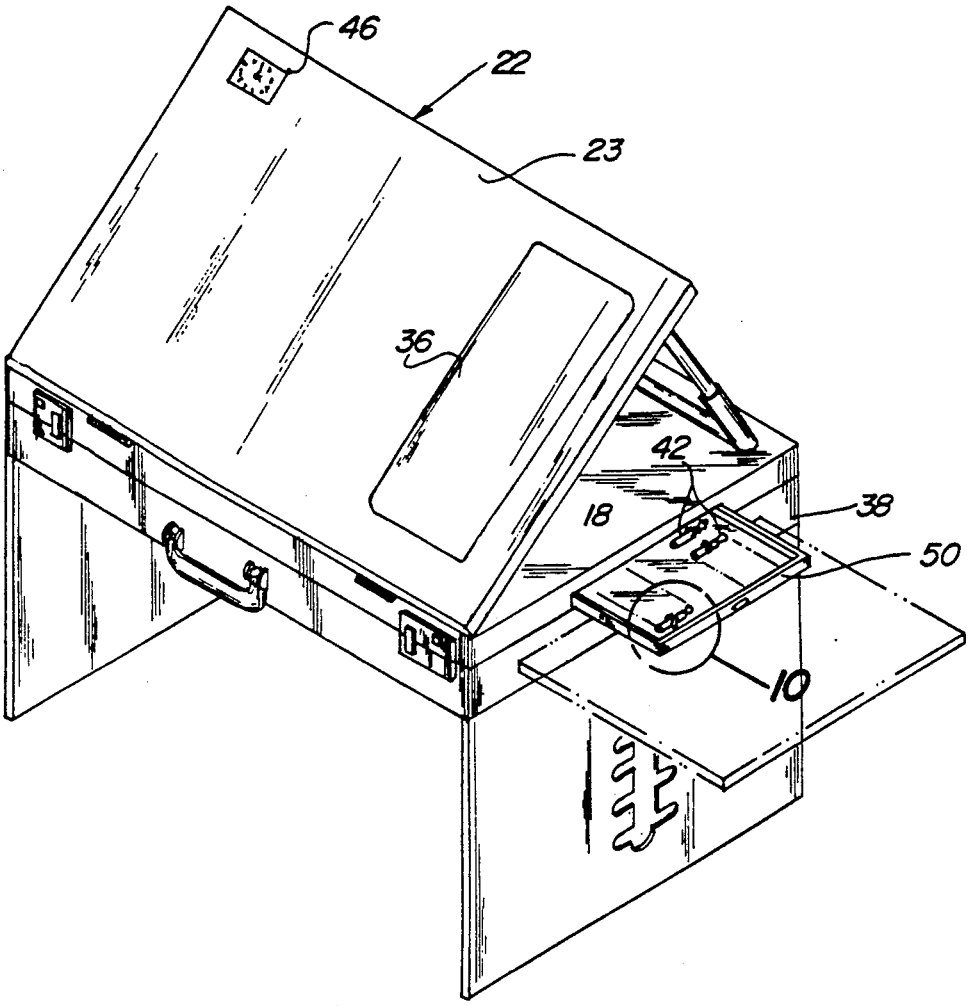
FIG. 9 is an isometric illustration of the desk structure utilizing the accessory tray slidably mounted through the lid within the desk organization.
Figure 10:
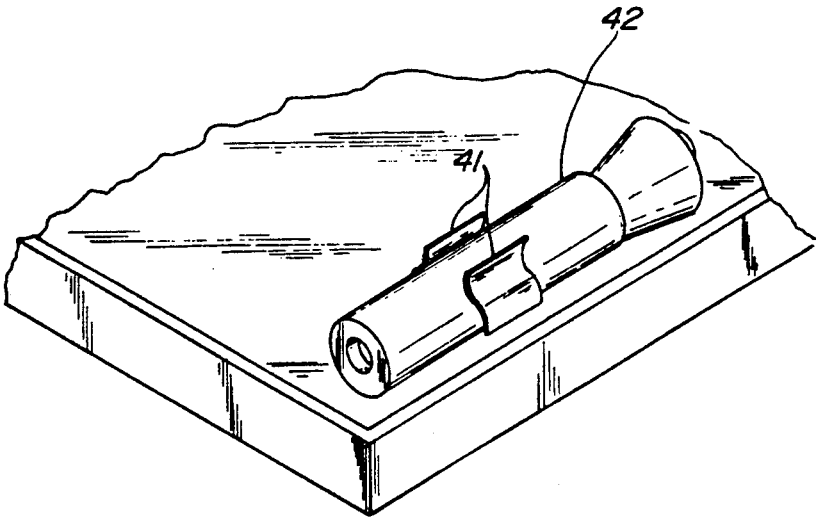
FIG. 10 is an enlarged isometric illustration of section 10 as set forth in FIG. 9.

The FIGS. 9 and 10 illustrate the accessory tray structure 50 mounted within the desk organization, and more specifically to the lid 18 through a side wall thereof, utilizing the U-shaped spring jaws 41 to secure the writing instruments 42 therewithin. The accessory tray structure 50 may optionally be directed into the desk structure, as required, and removed for storage therein if needed thusly by a user thereof. Further it should be noted that the container 38 may further be stored within the desk structure if so desired by an individual user thereof.

As to the manner of usage and operation of the instant invention, the same should be apparent from the above disclosure, and accordingly no further discussion relative to the manner of usage and operation of the instant invention shall be required.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bed supported desk apparatus for mounting to a top surface of a bed, wherein the apparatus comprises, a support housing, the support housing including spaced parallel housing side walls, a housing front wall spaced from and parallel a housing rear wall, and a housing bottom wall, and a housing lid hingedly mounted to the housing rear wall, including a first hinge mounting a housing lid rear edge to the housing rear wall, and at least one latch member for selectively securing a housing lid front edge spaced from and parallel a housing lid rear edge to the housing front wall, and a support plate, wherein the support plate includes a support plate rear edge and a support plate front edge, the support plate front edge hingedly mounted to the housing lid front edge to include a second hinge secured to the housing lid front edge and the support plate front edge, and the housing bottom wall includes a plurality of parallelepiped leg tubes hingedly mounted to the support housing, wherein each of said plurality of leg tubes includes a fourth hinge to hingedly mount each leg tube to one of said housing side walls, and each leg tube includes an extension plate telescopingly received within each leg tube, and a plurality of parallel arresting slots in communication with a latch slot mounted through each leg tube, wherein each extension plate includes a "T" shaped latch projection for selective projection through the latch slot and arresting slot of a respective leg tube to permit selective extension of each extension plate.

2. An apparatus as set forth in claim 1 wherein at least one of said housing side walls includes a slide plate socket, and the slide plate socket includes a slide plate telescopingly received through the slide plate socket from within the support housing.

3. An apparatus as set forth in claim 2 wherein at housing lid includes a housing lid top wall, the housing lid top wall includes a groove arranged parallel relative to the housing rear wall, and the groove includes at least one bottom leg tube, the groove defined by a predetermined height and the bottom leg tube defined by a predetermined diameter substantially equal to the predetermined height, and the bottom leg tube includes a bottom leg tube extension telescopingly received relative to the bottom leg tube, whereupon the bottom leg tube and bottom leg tube extension are arranged for positioning in the first position within the groove and arranged for displacement from the groove in an interposed relationship between the housing lid top wall and a bottom surface of the support plate.

4. An apparatus as set forth in claim 3 wherein the support plate includes at least one clip member to support a work sheet relative to a top surface of the support lid, and further including a rigid light reflective polymeric web insert coplanar with the support plate top surface positioned below said clip, and the web insert includes a writing instrument container hingedly mounted to a lower edge of the web insert, wherein the writing instrument container includes an instrument container hinge, and the instrument container includes a third hinge hingedly mounting the instrument container to a lower edge of the web insert, and the third hinge includes a removable rod removably coaxially mounted relative to the third hinge, whereupon removal of the rod permits removal of the writing instrument container relative to the web insert, and the writing instrument container includes a plurality of "U" shaped spring jaws mounted to a floor of the writing instrument container, and the spring jaws include at least one writing instrument contained within the "U" shaped spring jaws.

* * * * *